US007691008B2

(12) United States Patent
Oyama

(10) Patent No.: US 7,691,008 B2
(45) Date of Patent: Apr. 6, 2010

(54) GOLF CLUB HEAD

(75) Inventor: Hitoshi Oyama, Kobe (JP)

(73) Assignee: SRI Sports Limited, Kobe (JP)

( * ) Notice: Subject to any disclaimer, the term of this patent is extended or adjusted under 35 U.S.C. 154(b) by 0 days.

(21) Appl. No.: 11/699,489

(22) Filed: Jan. 30, 2007

(65) Prior Publication Data

US 2007/0202963 A1 Aug. 30, 2007

(30) Foreign Application Priority Data

Feb. 27, 2006 (JP) ..... 2006-050765

(51) Int. Cl.
*A63B 53/04* (2006.01)

(52) U.S. Cl. ..... 473/345; 473/349

(58) Field of Classification Search ..... 473/324–350
See application file for complete search history.

(56) References Cited

U.S. PATENT DOCUMENTS 5,467,983 A * 11/1995 Chen ..... 473/342
5,697,855 A * 12/1997 Aizawa ..... 473/350
6,334,817 B1 * 1/2002 Ezawa et al. ..... 473/324
6,524,194 B2 * 2/2003 McCabe ..... 473/305
7,063,629 B2 6/2006 Nakahara et al.
7,066,835 B2 * 6/2006 Evans et al. ..... 473/346
7,204,768 B2 * 4/2007 Nakahara et al. ..... 473/329

FOREIGN PATENT DOCUMENTS

EP 1277499 A2 1/2003
JP 2002065913 A * 3/2002
JP 2005152073 A * 6/2005

* cited by examiner

*Primary Examiner*—Alvin A Hunter
(74) *Attorney, Agent, or Firm*—Birch, Stewart, Kolasch & Birch, LLP

(57) ABSTRACT

A golf club head has a hollow shell structure comprising: a main frame provided with three independent openings which are a front opening, a top opening and a bottom opening; a face plate covering the front opening; a crown plate covering the top opening; and a sole plate covering the bottom opening. The specific gravity Gc of the crown plate, the specific gravity Gf of the face plate and the specific gravity Gs of the sole plate are each smaller than the specific gravity Gm of the main frame. Preferably, the specific gravity Gc is smaller than the specific gravity Gf and smaller than the specific gravity Gs, and the main frame is made of a metal material. Therefore, the freedom of designing the center of gravity the club head can be increased.

19 Claims, 6 Drawing Sheets

GOLF CLUB HEAD

BACKGROUND OF THE INVENTION

The present invention relates to a golf club head, more particularly to a shell structure for a hollow head capable of increasing the freedom of designing the center of gravity the club head.

In recent years, wood-type golf club heads composed of a metal part and a nonmetal part have been proposed.

In European patent application EP 1277499 A2, a wood-type hollow golf club head composed of a face component made of a metal material and an aft body made of nonmetal materials is disclosed. In this structure, it is difficult to freely design the vertical position of the center of gravity of the head by changing the weight distribution of the head.

In U.S. Pat. No. 7,063,629, a wood-type hollow head composed of shell members made of a metal material and a fiber-reinforced plastic is disclosed. In this structure, the fiber-reinforced plastic is used in the crown portion of the club head, and as a result, it is difficult to freely design the position of the center of gravity in the back-and-forth direction of the head by changing the weight distribution of the head.

SUMMARY OF THE INVENTION

It is therefore, an object of the present invention to provide a golf club head which has a shell structure capable of changing its weight distribution easily and thereby being capable of increasing the freedom of designing the center of gravity of the club head.

According to the present invention, a golf club head has a hollow shell structure comprising: a main frame provided with three independent openings which are a front opening, a top opening and a bottom opening; a face plate covering the front opening; a crown plate covering the top opening; and a sole plate covering the bottom opening, wherein the specific gravity Gc of the crown plate, the specific gravity Gf of the face plate and the specific gravity Gs of the sole plate are each smaller than the specific gravity Gm of the main frame.

Preferably, the specific gravity Gc is smaller than the specific gravity Gf and smaller than the specific gravity Gs, and the main frame is made of a metal material.

Therefore, by changing the specific gravity of the face plate, the specific gravity and size of the crown plate and/or the specific gravity and size of the sole plate, the center of gravity of the head can be adjusted to substantially anyplace desirable for improving the head performance. Further, the main frame can provide a large moment of inertia as well as a necessary strength for the head.

BRIEF DESCRIPTION OF THE DRAWINGS

Embodiments of the present invention will now be described in detail in conjunction with the accompanying drawings, in which.

DESCRIPTION OF THE PREFERRED EMBODIMENTS

Figure 1:
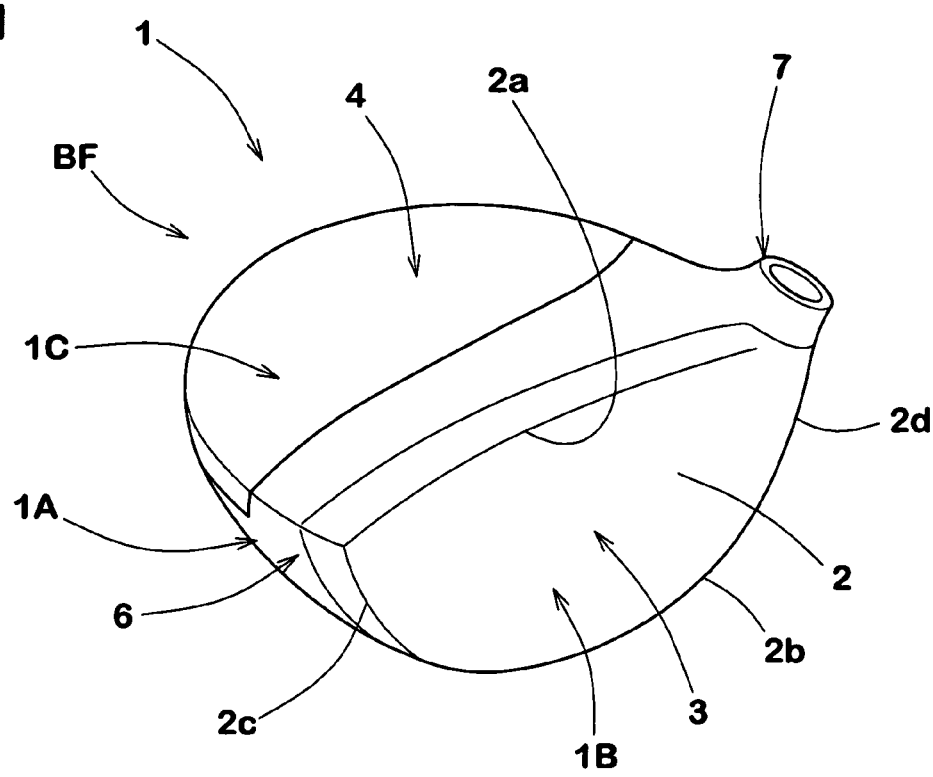
FIG. 1 is a perspective view of a wood-type golf club head according to the present invention.
Figure 2:
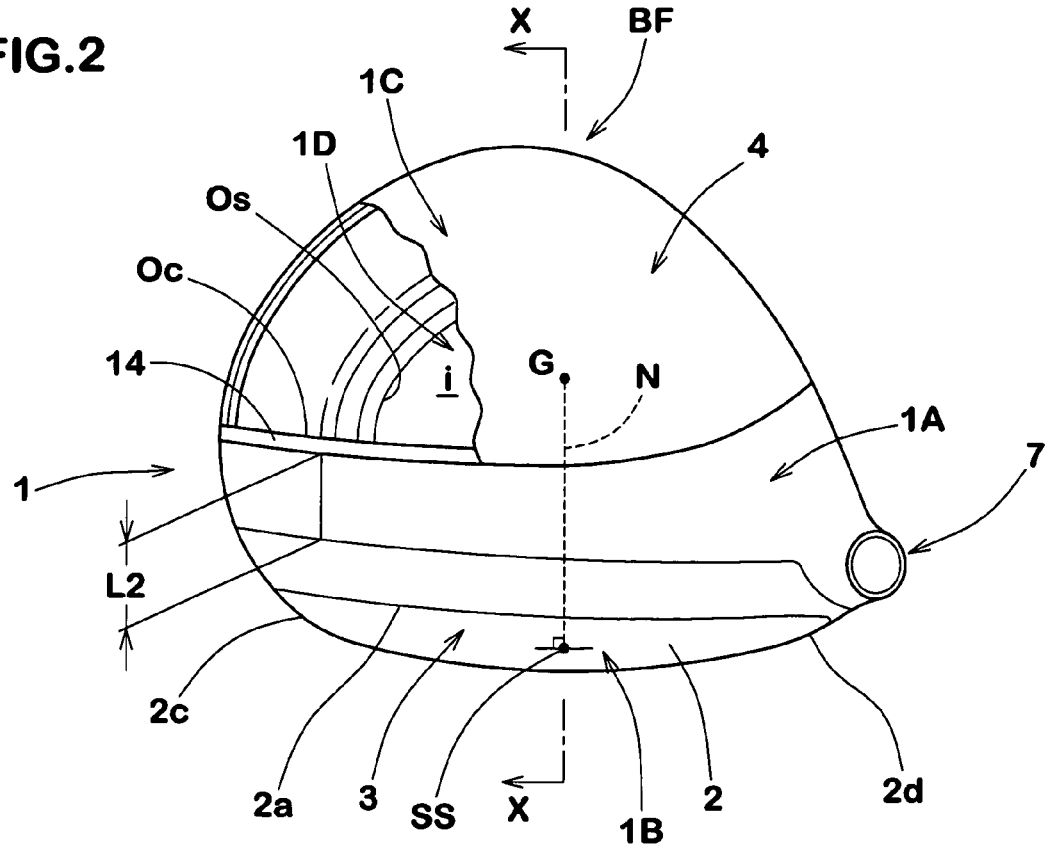
FIG. 2 is a top view thereof.
Figure 3:
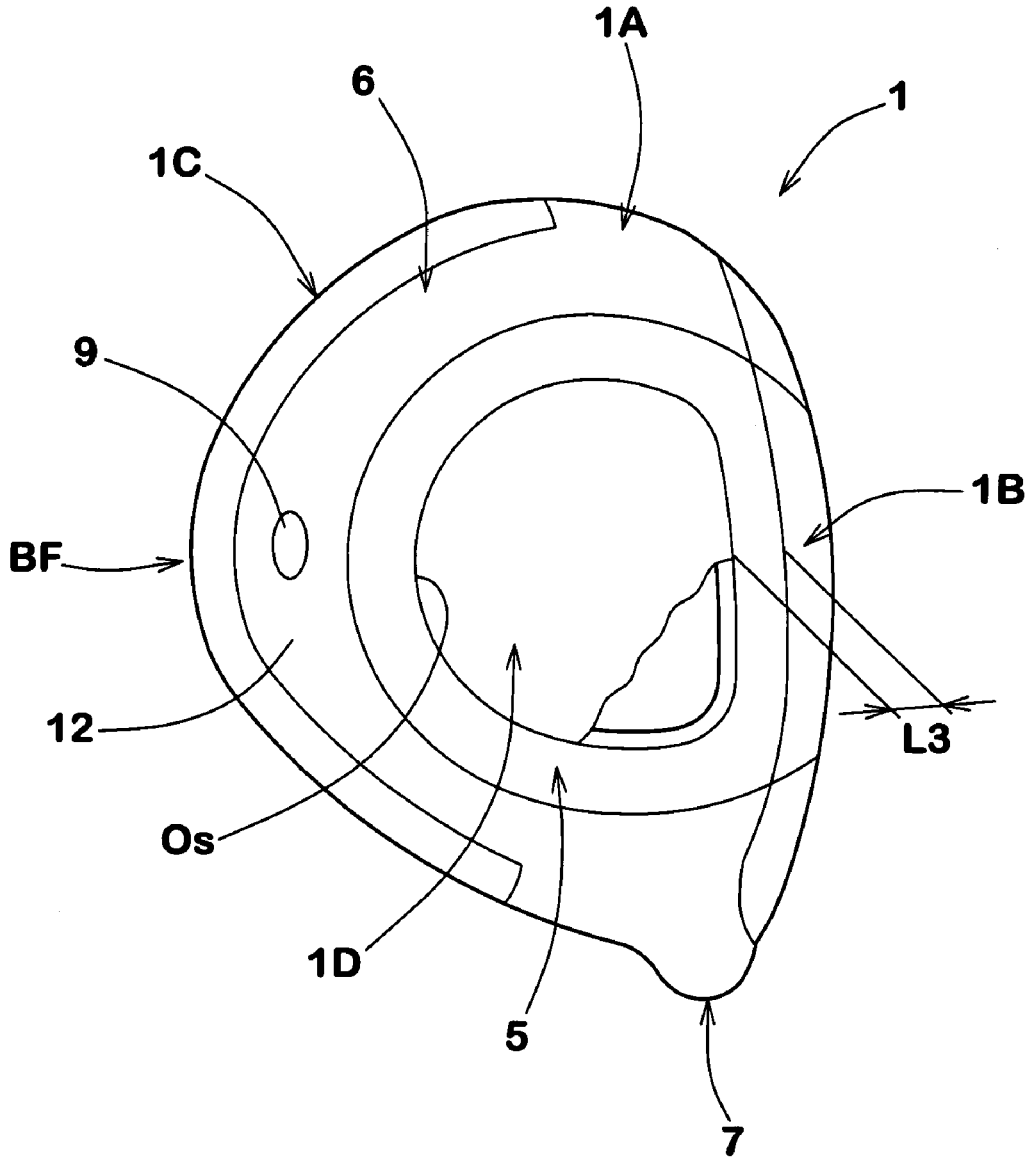
FIG. 3 is a bottom view thereof.
Figure 4:
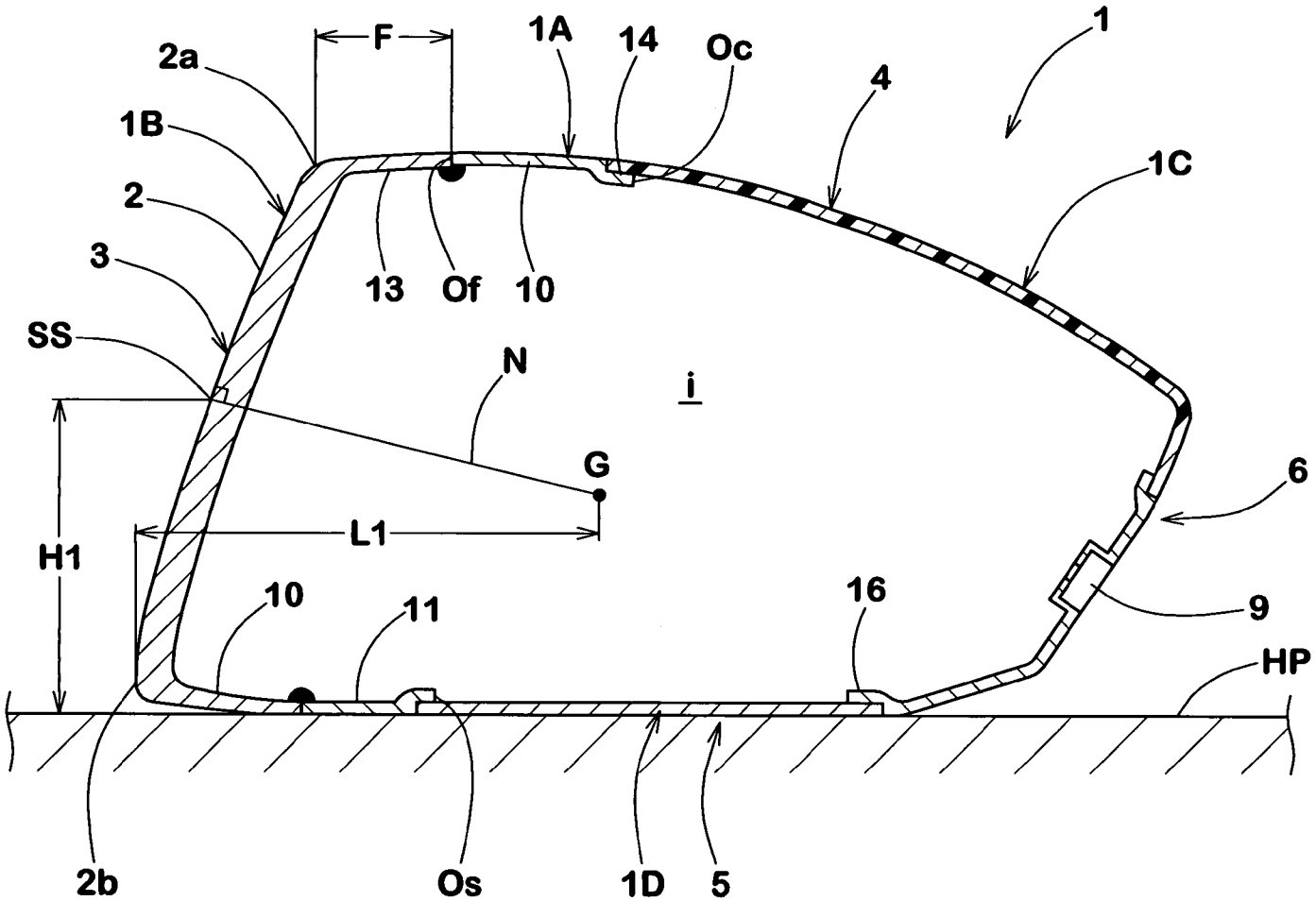
FIG. 4 is a cross sectional view taken along line X-X in FIG. 2.

In the drawings, club head 1 according to the present invention is a hollow head for a wood-type golf club such as driver (#1) or fairway wood, and comprises: a face portion 3 whose front face defines a club face 2 for striking a ball; a crown portion 4 defining a top surface of the head intersecting the club face 2 at the upper edge 2*a* thereof; a sole portion 5 defining a bottom surface of the head intersecting the club face 2 at the lower edge 2*b* thereof; a side portion 6 between the crown portion 4 and sole portion 5 which extends from a toe-side edge 2*c* to a heel-side edge 2*d* of the club face 2 through the back face BF of the club head; and a hosel portion 7 at the heel side end of the crown to be attached to an end of a club shaft (not shown) inserted into the shaft inserting hole 7*a*. The club head 1 has a hollow shell structure as shown in FIG. 4.

Definitions

In the following description, the dimensions refer to the values measured under the standard state of the club head unless otherwise noted.

Here, the standard state of the club head 1 is such that the club head is set on a horizontal plane HP so that the axis of the clubshaft(not shown) is inclined at the lie angle while keeping the center line on a vertical plane, and the clubface 2 forms its loft angle with respect to the horizontal plane HP. Incidentally, in the case of the club head alone, the center line of the shaft inserting hole 7*a* can be used instead of the axis of the clubshaft.

The moment of inertia is the lateral moment of inertia around a vertical axis passing through the center of gravity G in the standard state.

The sweet spot SS is the point of intersection between the clubface 2 and a straight line N drawn normally to the clubface 2 passing the center of gravity G of the head. (see FIG. 4)

The back-and-forth direction is a direction parallel with the straight line N projected on the horizontal plane HP.

The heel-and-toe direction is a direction parallel with the horizontal plane HP and perpendicular to the back-and-forth direction.

In this embodiment, the club head 1 is a wood-type club head for a driver (#1). It is therefore, preferable that the head volume is set in a range of not less than 360 cc, more preferably not less than 380 cc in order to increase the moment of inertia and the depth of the center of gravity. However, to prevent an excessive increase in the club head weight and deteriorations of swing balance and durability and further in view of golf rules or regulations, the head volume is set in a range of not more than 470 cc, preferably not more than 460 cc.

The mass of the club head 1 is preferably set in a range of not less than 170 grams, more preferably not less than 180 grams, but not more than 250 grams, more preferably not more than 240 grams in view of the swing balance and the like. In the case of driver, it is especially preferable that the mass is not more than 200 grams.

Further, for increasing the traveling distance of a ball, it is preferable that the height H1 of the center of gravity is not more than 34 mm, more preferably not more than 32 mm, still more preferably not more than 30 mm, but from a practical standpoint, not less than 25 mm.

It is also preferable for the directionality that the depth L1 of the center of gravity is not less than 33 mm, more preferably not less than 35 mm, but from a practical standpoint, not more than 45 mm. Further, the moment of inertia is preferably set in a range of not less than 4000 gram×cm^2, more preferably not less than 4200 gram×cm^2, still more preferably not less than 4300 gram×cm^2, but from a practical standpoint, not more than 5000 gram×cm^2.

Figure 5:
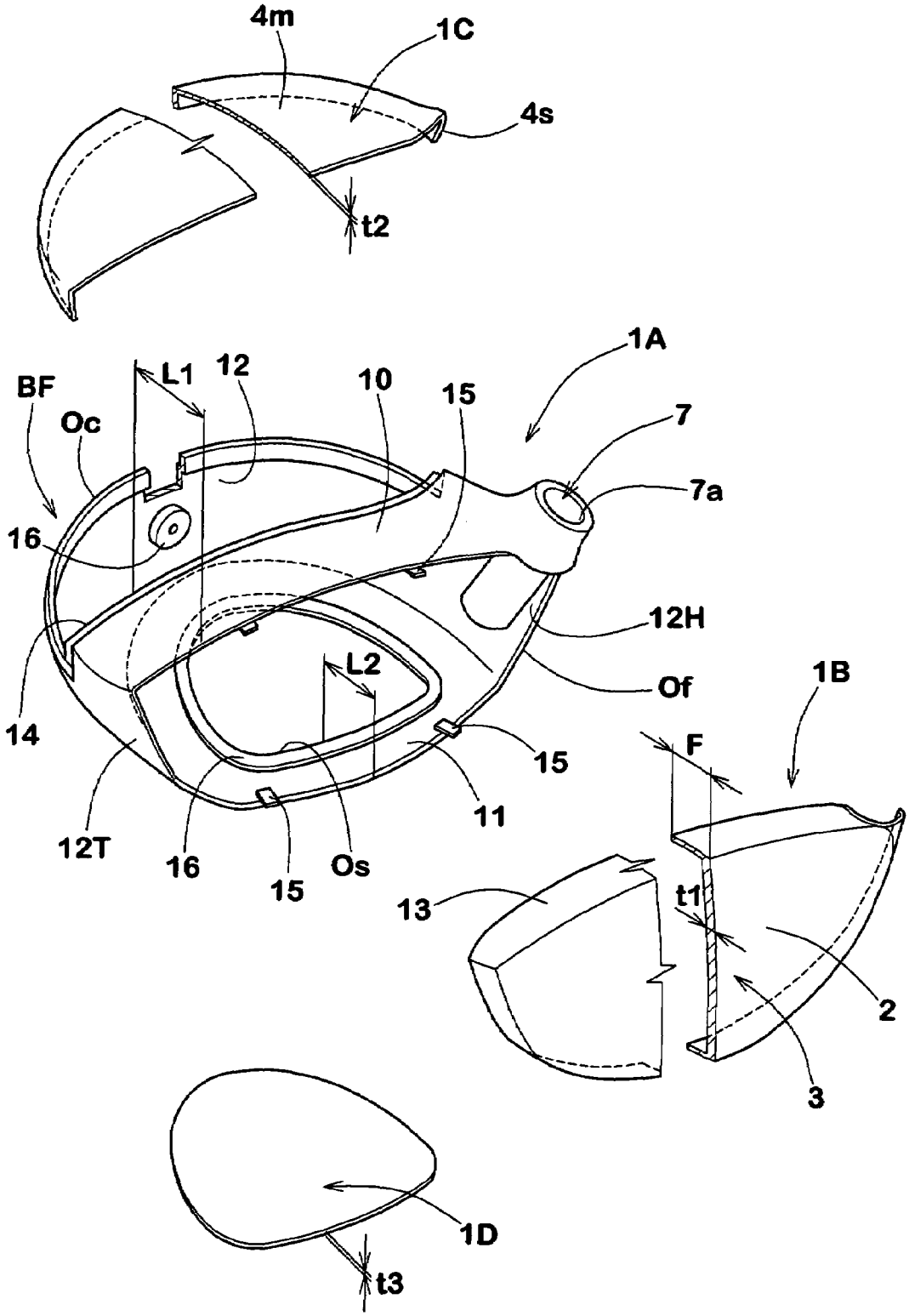
FIG. 5 is an exploded perspective view of the club head.

In order to achieve such a desirable positioning of the center of gravity and the mass distribution capable of achieving a larger moment of inertia, the club head 1 has a four-piece structure which is, as best shown in FIG. 5, made up of a main frame 1A, a face plate 1B, a crown plate 1C and a sole plate 1D, wherein the face plate 1B, crown plate 1C and sole plate 1D are each made of a material whose specific gravity is less than that of the main frame 1A.

The main frame 1A is provided with three independent openings: a front opening Of; a top opening Oc and a bottom opening Os. As a result, the main frame 1A integrally posses: an upper frame 10 between the front opening Of and top opening Oc which forms a part of the crown portion 4; a lower frame 11 between the front opening Of and bottom opening Os which forms a part of the sole portion 5; a side frame 12 between the top opening Oc and bottom opening Os which forms a part of the side portion 6; and the hosel portion 7.

In this embodiment, the bottom opening Os is smallest and does not protrude from the sole portion 5. As a result, the above-mentioned side frame 12 further includes a part of the sole portion 6. The bottom opening Os has a round shape similar to but smaller than the shape of the sole portion 5. Of course, it is possible to form the bottom opening Os so as to protrude into the side portion 6 and/or to have another shape.

The top opening Oc is largest and it can be considered as protruding from the crown portion 4 into the side portion 6. The front opening Of can be considered as protruding from the face portion 3 into the crown portion, sole portion and side portion.

Preferably, the weight Wm of the main frame 1A is set in a range of not less than 30 grams, more preferably not less than 35 grams, still more preferably not less than 40 grams, but not more than 100 grams, more preferably not more than 95 grams, still more preferably not more than 85 grams. If less than 30 grams, it becomes difficult to maintain a necessary strength and a larger moment of inertia. If more than 100 grams, as the weight of the face plate, crown plate and sole plate is relatively decreased, the adjustable range becomes decreased.

Preferably, the specific gravity Gm of the main frame 1A is set in a range of not less than 3.0, more preferably not less than 4.0, but not more than 8.0, more preferably not more than 7.0, still more preferably not more than 5.0. If less than 3.0, the durability, strength and resistance to external injury are liable to deteriorate. If more than 8.0, an excessive decrease in the head volume is necessitated to maintain the club head weight.

To achieve these requirements, preferably used is a metal material such as stainless steels, maraging steels, aluminum alloys, titanium alloys and pure titanium, or the like.

If the upper frame 10 and lower frame 11 are too large, the opening areas decrease and the original objectives are lost. Therefore, the minimum lengths L2 and L3 of the upper frame 10 and lower frame 11, respectively, in the back-and-forth direction of the club head are set in a range of not more than 30 mm, preferably not more than 25 mm. But, in view of the strength and durability, it is preferable that the lengths L2 and L3 are set in a range of not less than 5 mm, more preferably not less than 8 mm.

The front opening Of is closed by the face plate 1B which is attached to the main frame 1A by fixing the peripheral edge of the face plate 1B to the edge of the front opening Of which edge is defined by the front edges of the upper frame 10, the lower frame 11 and the toe-side part 12T and heel-side part 12H of the side frame 12.

The top opening Oc is closed by the crown plate 1*c* which is attached to the main frame 1A by fixing the peripheral edge of the crown plate 1*c* to the edge of the top opening Oc. The bottom opening Os is closed by the sole plate 1D which is attached to the main frame 1A by fixing the peripheral edge of the sole plate 1D to the edge of the bottom opening Os.

The face plate 1B includes the entirety of the face portion 3, and in this embodiment, a turnback 13 is integrally formed therewith. The turnback 13 extends backwards from at least a part of the peripheral edge (2*a*, 2*b*, 2*c* and 2*d*) of the clubface 2. As shown in FIG. 5, the turnback 13 in this example is formed substantially continuously around the clubface 2 excepting a part for avoiding the hosel 7, therefore, the turnback 13 forms the front end zone of the crown portion 4, sole portion 5 and side portion 6.

Preferably, the surface area of the face plate 1B is set in a range of not less than 12%, more preferably not less than 15%, but not more than 35%, more preferably not more than 30% of the overall surface area of the head 1.

The face plate 1B has a specific gravity Gf less than the specific gravity Gm of the main frame 1A. This will serve to increase the depth of the center of gravity. The difference Gm−Gf is not less than 0.02, preferably not less than 0.04, more preferably not less than 0.06, but not more than 5.0, preferably not more than 3.0, more preferably not more than 1.0.

Preferably, the specific gravity Gf is not less than 3.0, more preferably not less than 4.0, but not more than 8.0, more preferably not more than 7.0, still more preferably not more than 5.0. If less than 3.0, it becomes difficult to maintain the durability, strength and resistance to external injury of the face portion 3. If more than 5.0, it is difficult to maintain the depth of the center of gravity.

If the face plate 1B is too heavy, it is difficult to set the center of gravity at a suitable depth L1. If too light, it is inevitable that the strength and durability become insufficient. Therefore, the weight Wf of the face plate 1B is preferably set in a range of not more than 80 grams, more preferably not-more than 75 grams, still more preferably not more than 70 grams, but, not less than 40 grams, more preferably not less than 45 grams, still more preferably not less than 50 grams. In other words, the weight Wf is preferably not less than 50%, more preferably not less than 60%, but, not more than 160%, more preferably not more than 125% of the weight Wm of the main frame 1A.

The face plate 1B may be made form a nonmetal material, but preferably a metal material is used. For example, titanium alloys, pure titanium, maraging steels, stainless steels, aluminum alloys and the like can be used. In any case, it is preferable for the face portion 3 that its central part including the sweet spot SS or centroid has a thickness t1 in the range of not less than 2.5 mm in order to assure durability at impact.

The crown plate 1C includes a generally-semicircular aft part 4*m* of the crown portion 4, and in this embodiment, a turndown 4*s* is integrally formed therewith. The turndown 4*s* extends downward from the arched rear edge of the aft part 4*m* excepting the front edge so the turndown 4*s* forms an upper part of the side portion 6.

The surface area of the crown plate 1C is not less than 15%, preferably not less than 20%, but not more than 45%, preferably not more than 40% of the overall surface area of the head 1.

The crown plate 1C has a specific gravity Gc less than the specific gravity Gm of the main frame 1A. This will serve to lower the height of the center of gravity. The difference Gm−Gc is not less than 1.5, preferably not less than 2.0, more preferably not less than 2.5, but not more than 6.0, preferably not more than 5.0, more preferably not more than 4.0.

Preferably, the specific gravity Gc is set in a range of not more than 5.0, more preferably not more than 4.0, still more preferably not more than 3.0, but, not less than 0.5, more preferably not less than 1.0. If less than 0.5, it is difficult to maintain the strength of the crown portion 4. If more than 5.0, it is difficult to lower the height of the center of gravity.

If the weight Wc of the crown plate 1C is more than 30 grams, the height of the center of gravity is undesirably increased. If less than 3 grams, it becomes difficult to maintain the strength of the crown plate 1C. Therefore the weight Wc is preferably set in a range of not more than 30.0 grams, more preferably not more than 25 grams, still more preferably not more than 20 grams, but not less than 3 grams, more preferably not less than 4 grams, still more preferably not less than 5 grams. In other words, the weight Wc is preferably not less than 3%, more preferably not less than 5%, but not more than 60%, more preferably not more than 45% of the weight Wm of the main frame 1A.

The crown plate 1C is preferably made from a fiber reinforced resin. In this embodiment, a carbon fiber reinforced resin (CFRP) which is a combination of an epoxide resin and carbon fiber is used. But it is of course possible to use various combination of resin and fiber.

Aside from such fiber reinforced resins, metal materials, e.g. titanium alloys, aluminum alloys, magnesium alloys and the like can be used. In any case, it is preferable that the thickness t2 of the crown plate 1C is not less than 0.5 mm for the strength, durability and the like.

The sole plate 1D forms a central part of the sole portion 5, and in this embodiment, it is an almost flat plate.

The surface area of the sole plate 1D is not less than 5%, preferably not less than 10%, but not more than 35%, preferably not more than 30% of the overall surface area of the head.

The sole plate 1D has a specific gravity Gs less than the specific gravity Gm of the main frame 1A. The difference Gm−Gs is not less than 0.02, preferably not less than 0.04, more preferably not less than 0.06, but not more than 5.5, preferably not more than 4.0, more preferably not more than 3.5.

Preferably, the specific gravity GS is set in a range of not less than 1.0, more preferably not less than 1.5, but not more than 7.0, more preferably not more than 5.0, still more preferably not more than 3.0. If less than 1.0, the strength tends to become insufficient for the sole portion 5. If more than 7.0, there is a possibility that the moment of inertia becomes undesirably small.

If the weight Ws of the sole plate 1D is too heavy, there is a tendency that the moment of inertia of the club head becomes small. Therefore, the weight Ws of the sole plate 1D is preferably set in a range of not more than 70 grams, more preferably not more than 65 grams, still more preferably not more than 60 grams, but not less than 5 grams, more preferably not less than 7 grams, still more preferably not less than 10 grams. In other words, the weight Ws is preferably not less than 5%, more preferably not less than 10%, but not more than 140%, more preferably not more than 100% of the weight Wm of the main frame 1A.

The sole plate 1D can be made from a nonmetal material, but a metal material is preferably used. For example, stainless steels, maraging steels, aluminum alloys, titanium alloys, pure titanium and the like can be used. In any case, it is preferable for the durability that the thickness t3 of the sole plate 1D is not less than 0.5 mm.

The specific gravities Gm, Gf, Gc and Gs may be determined independently as far as the above conditions are satisfied. But, it is preferred that the following specific conditions are met.

When lowering the center of gravity as far as possible, it is preferable that the specific gravity Gc of the crown plate 1C is less than the specific gravity Gf of the face plate 1B and also less than the specific gravity Gs of the sole plate 1D.

$Gc<Gf$ and $Gc<Gs$

The difference Gf−Gs is preferably not smaller than −1.0, more preferably not smaller than −(minus) 0.5, still more preferably not smaller than 0, most preferably more than 0, but not more than 7.0.

When increasing the moment of inertia, it is desirable to satisfy the following condition: $Gc<Gs<Gf<Gm$.

The above-mentioned main frame 1A can be formed by forging or bending a rolled metal material, or assembling two or more parts. But, preferably, casting, especially lost-wax precision casting is employed. In this embodiment, the main frame 1A is a lost-wax precision casting of a metal material having the specific gravity Gm.

In order to support the peripheral part of the inner surface of the crown plate 1C, a projecting part 14 of 3 to 8 mm is formed around the top opening Oc. In this example, the projecting part 14 extends continuously along the entire length of the edge of the top opening Oc, but it may be formed discontinuously.

In order to support the peripheral part of the inner surface of the sole plate 1D, a projecting part 16 is formed around the bottom opening Os. In this example, the projecting part 16 extends continuously along the entire length of the edge of the bottom opening Os, but it may be formed discontinuously.

In order to support the peripheral part of the inner surface of the face plate 1B and also for the purpose of positioning, projecting parts 15 are provided discontinuously around the front opening Of.

The face plate 1B can be formed by forging and/or press working. In this embodiment, the rear edge of the turnback 13 is welded to the front edge of the front opening Of. In the case of another structure, it is of course possible to employ another fixing method, e.g. caulking, adhesive and the like alone or in combination.

The turnback 13 can distance the rigid weld bead from the face portion and lessen the influence of heat during welding upon the crystalline structure of the metal material forming the clubface. When welding the face plate 1B, the above-mentioned projecting parts 15 can place the face plate in place and form a very small gap between the above-mentioned rear edge and front edge to be butt-welded.

The sole plate 1D can be formed by forging, press working, casting or the like according to the material. The sole plate 1D is inserted in the bottom opening Os to contact with the projecting part 16. Upon contact, the surface of the sole plate 1D becomes flush with the surface of the surrounding portion. Then, the peripheral edge of the sole plate 1D is overlap jointed to the projecting part 16 by means of adhesive agent or welding.

The crown plate is formed by laminate molding of prepreg sheets, and after cured by applying heat and pressure, the edge portion of the crown plate 1C is overlap jointed to the projecting part 14 of the top opening Oc by the use of an adhesive agent. When the edge portion of the crown plate 1C contacts with the projecting part 14, the outer surface of the crown plate 1C becomes flush with the outer surface of the surrounding portion of the main frame.

In another method of making the crown plate 1C from prepreg sheets, prepreg sheets are applied to the main frame 1A so as to cover the top opening Oc. Then, a mold is set outside the prepreg sheets, and an inflatable bladder is inserted in the main frame. And during a high pressure is applied to the inside of the prepreg sheets by inflating the bladder, the prepreg sheets is cured by applying heat. In this case, the molding of the crown plate 1C and the fixing to the main frame can be made at once.

The weight margin which can be obtained by adopting the above-mentioned structure, is distributed to a suitable portion so as to increase the depth of the center of gravity and decrease the height of the center of gravity.

Figure 6:
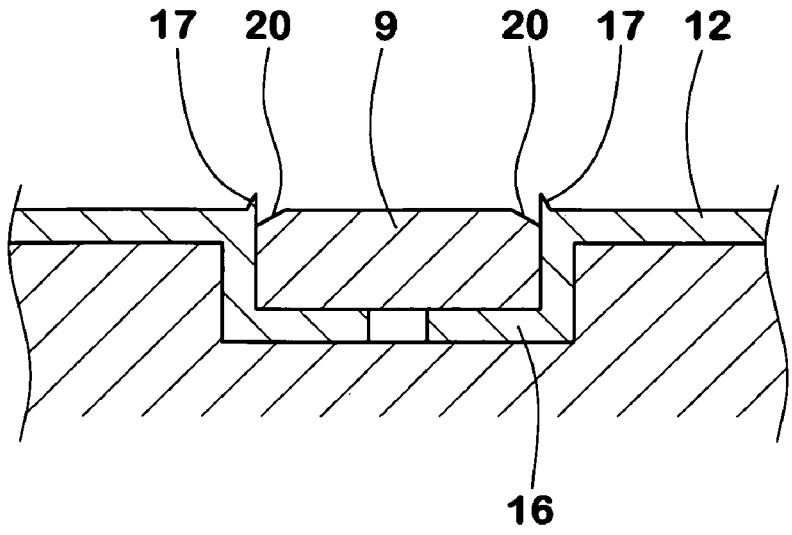
FIGS. 6 and 7 are enlarged cross sectional views for explaining a method for fixing an additional weight member.
Figure 7:
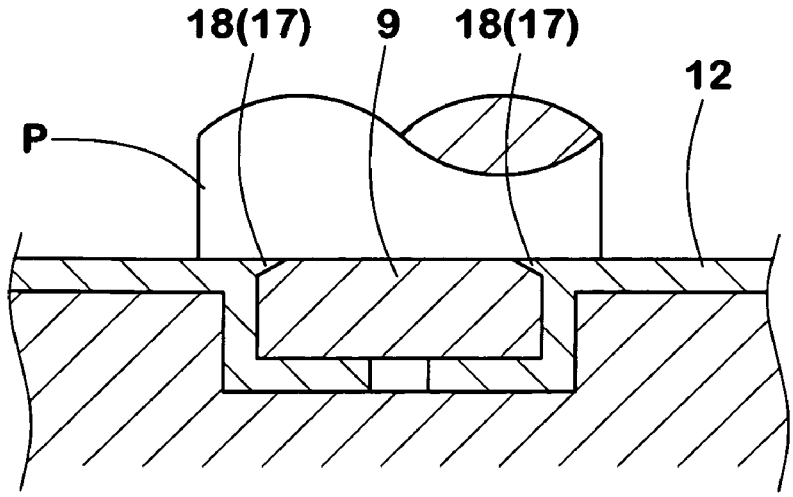

In this embodiment, without changing the thickness distribution, in other words, to avoid a large thickness variation in the main frame, a separate weight member 9 is used at the rear end (side frame 12) of the main frame 1A. The weight member 9 is fitted into a hole 16 formed on the rear face BF. The hole 16 is a circular hole in this example, and along the edge of the opening, a deformable small protrusion 17 is provided as shown in FIG. 6. The weight member 9 has a columnar shape almost same as the hole 16, and the peripheral edge of the outer end of the weight member 9 is chamfered. After the weight member 9 is inserted into the hole 16, the protrusion 17 is plastic deformed onto the chamfer 20 as shown in FIG. 7 by the use of a hammer or the like. Accordingly, the weight member 9 is secured in the hole 17 by the deformed protrusion 18(17).

For the weight member 9, it is desirable to use a heavy material having a specific gravity which is more than that of the main frame 1A and not less than 4.0, preferably not less than 7.0, but from a practical standpoint, not more than 20.0, preferably not more than 18.0. For example, copper alloys, nickel alloys, brass, lead, stainless steels, pure tungsten, tungsten alloys and the like can be used alone or in combination.

WORKING EXAMPLES

The following wood club heads having the specifications given in Table 1 were made and tested for the ball hitting sound, and the ball traveling distance and directionality. Further, the height and depth of the center of gravity and the moment of inertia were measured.

Example 1

The main frame was a casting of Ti-15V-3Cr-3Al-3Sn having a specific gravity of 4.76. The face plate was a forging of Ti-5Al-1Fe having a specific gravity of 4.38, and the turnback of 10 mm (dimension F) was provided as shown in FIG. 5. The crown plate was a casting of a magnesium alloy AM60B having a specific gravity of 1.80. The sole plate was a press molding of an aluminum alloy (7075) having a specific gravity of 2.85. The face plate was welded to the main frame by plasma welding, then the crown plate and sole plate were fixed to the main frame by means of adhesive agent. The weight member of a sintered W—Ni alloy having a specific gravity of 12.0 was embedded in the side frame and secured by means of an adhesive agent and plastic deformation of the protrusion 17 as show in FIGS. 6 and 7.

Example 2

A modification of Example 1 wherein as the crown plate, a molding of a CFRP having a specific gravity of 1.6 was used instead. The crown plate was a lamination of prepreg sheets which was press molded by applying heat and pressure. The crown plate became 1 gram lighter than that of Example 1, therefore, the weight member 9 being 1 gram heavier was used.

Example 3

A modification of Example 1 wherein as the face plate, a forging of Ti-6Al-4V having a specific gravity of 4.42 was used instead, and further, as the sole plate, a forging of Ti-5Al-1Fe having a specific gravity of 4.38 was used instead. The sole plate was welded to the main frame. In this Example, in order to adjust the club head weight to 195 grams, the weight member was omitted and further, the thickness of the sole portion was partially decreased.

Example 4

A modification of Example 1 wherein as the crown plate, a press molding of an aluminum alloy (7075) having a specific gravity of 2.85 was used, and as the sole plate, a press molding of a magnesium alloy (AM60B) having a specific gravity of 1.80 was used instead. The crown plate became 6 grams heavier and the sole plate became 11 grams lighter. Therefore, the weight being 5 grams heavier was used.

Example 5

A modification of Example 1 wherein as the crown plate and sole plate, laminations of CFRP having a specific gravity of 1.6 were used instead. The crown plate became 1.5 grams lighter, and the sole plate became 13 grams lighter. Therefore, the weight being 14.5 grams heavier was used.

Ref. 1

A modification of Example 1 wherein as the main frame, a forging of Ti-6Al-4V having a specific gravity of 4.42 was used instead. Further, as the face plate, a forging of Ti-15Mo-5Zr-3Al having a specific gravity of 5.01 was used instead.

Ref. 2

Figure 8:
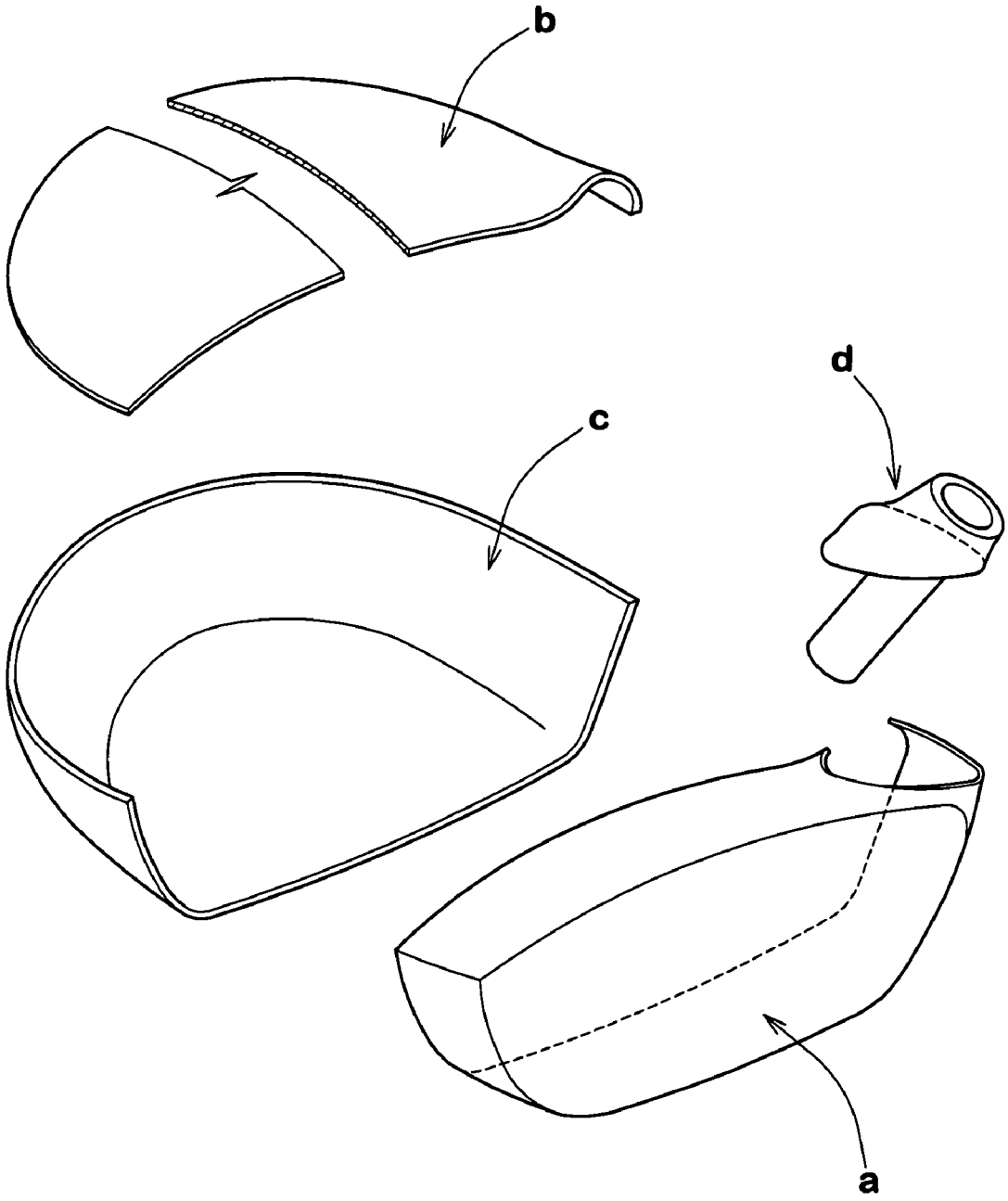
FIG. 8 is an exploded perspective view of a golf club head used as Ref.2 in the undermentioned comparison tests.

Ref. 2 had the structure shown in FIG. 8 comprising: a face plate (a) being a forging of Ti-5Al-1Fe having a specific gravity of 4.38; a crown plate (b) being a press molding of a magnesium alloy (AM60B) having a specific gravity of 1.80; a side and sole member (c) being a press molding of an aluminum alloy (7075) having a specific gravity of 2.85; and a hosel (d) made of pure titanium having a specific gravity of 4.51.

Height of Center of Gravity

As shown in FIG. 4, the height H1 of the sweet spot SS from the horizontal plane HP was measured as the height of the center of gravity.

Depth of Center of Gravity

As shown in FIG. 4, the horizontal distance L1 between the center of gravity G and the lower edge 2*b* of the clubface 2 (leading edge of the head) in the back-and-forth direction was measured as the depth of the center of gravity.

Moment of Inertia

The moment of inertia of the head around a vertical axis passing the center of gravity was measured with a moment of inertia measuring instrument, MODEL NO. 005-002 manufactured by INERTIA DYNAMICS Inc.

Ball Hitting Sound Test 45-inch wood golf clubs were made by combining the clubheads with identical shafts. The hitting sound was evaluated by five golfers. The majority evaluation for each head is shown in Table 1, wherein: "A" means "very good"; "B" means "good"; "C" means "passable"; and "X" means "bad".

Traveling Distance and Directional Test

Using the 45-inch wood golf clubs, the five golfers hit golf balls ten times per person, and the average traveling distance was obtained. Further, the average distance between the landing point and target was obtained as the directionality. The test results are show in Table 1.

TABLE 1

| | Example 1 | Example 2 | Example 3 | Example 4 | Example 5 | Ref. 1 | Ref. 2 |
|---|---|---|---|---|---|---|---|
| Club head | | | | | | | |
| Head volume (cc) | 460 | | | | | | |
| Head mass (g) | 195 | | | | | | |
| Structure | FIGS. 1-5 | FIGS. 1-5 | FIGS. 1-5 | FIGS. 1-5 | FIGS. 1-5 | FIGS. 1-5 | FIG. 8 |
| Specific gravity G | | | | | | | |
| Main frame Gm | 4.76 | 4.76 | 4.76 | 4.76 | 4.76 | 4.42 | — |
| Face plate Gf | 4.38 | 4.38 | 4.42 | 4.38 | 4.38 | 5.01 | 4.38 |
| Crown plate Gc | 1.80 | 1.60 | 1.80 | 2.85 | 1.60 | 1.80 | 1.80 |
| Sole plate Gs | 2.85 | 2.85 | 4.38 | 1.80 | 1.60 | 2.85 | 2.85 |
| Weight member | 12 | 12 | — | 12 | 12 | 12 | 12 |
| Gm − Gc | 2.96 | 3.16 | 2.96 | 1.91 | 3.16 | 2.62 | — |
| Gm − Gs | 1.91 | 1.91 | 0.38 | 2.96 | 3.16 | 1.57 | — |
| Gm − Gf | 0.38 | 0.38 | 0.34 | 0.38 | 0.38 | −0.59 | — |
| Gf − Gs | 1.53 | 1.53 | 0.04 | 2.58 | 2.78 | 2.16 | 1.53 |
| Gs − Gc | 1.05 | 1.25 | 2.58 | −1.05 | 0 | 1.05 | 1.05 |
| Mass of each part | | | | | | | |
| Main frame Wm (g) | 69 | 69 | 69 | 69 | 69 | 64 | |
| Face plate Wf(g) | 72 | 72 | 73 | 72 | 72 | 82 | 79 |
| Crown plate Wc(g) | 9 | 8 | 9 | 15 | 8 | 9 | 7 |
| Sole plate Ws (g) | 29 | 29 | 44 | 18 | 16 | 29 | 77 |
| Weight member Ww (g) | 16 | 17 | 0 | 21 | 30 | 11 | 8 |
| Hosel d (g) | | | | | | | 24 |
| Surface area | | | | | | | |
| Face plate (%) | 27 | 27 | 27 | 27 | 27 | 27 | — |
| Crown plate (%) | 36 | 36 | 36 | 36 | 36 | 36 | — |
| Sole plate (%) | 16 | 16 | 16 | 16 | 16 | 16 | — |
| Center of gravity | | | | | | | |
| Height H1 (mm) | 29.3 | 29.2 | 28.9 | 29.1 | 29.4 | 29.8 | 29.1 |
| Depth L1 (mm) | 38.9 | 38.9 | 38.5 | 39.1 | 39.4 | 38.6 | 38.2 |
| Moment of inertia (g × cm^2) | 4340 | 4360 | 4300 | 4230 | 4350 | 4120 | 3980 |
| Traveling distance (yard) | 245 | 244 | 251 | 247 | 241 | 236 | 239 |
| Directionality (yard) | 16.8 | 15.6 | 18.3 | 21.7 | 15.2 | 27.9 | 31.1 |
| Hitting sound | A | B | A | A | C | A | A |

Ref. 1: Since the main frame's specific gravity was small, and the face plate's specific gravity was large, the moment of inertia became decreased, and the height of the center of gravity became increased. Therefore, the traveling distance and directionality became worsen.
Ref. 2: Since the side and sole member's specific gravity was small, the moment of inertia became small, and the directionality became worsen.
Examples 1-5: Since the weight distribution was optimized, the center of gravity became low, and the moment of inertia was increased. As a result, the head was improved in the traveling distance and directionality.

The invention claimed is:

1. A golf club head having a hollow shell structure comprising:

a main frame provided with three independent openings which are a front opening, a top opening and a bottom opening;

a face plate covering the front opening, the face plate comprising a face portion forming the clubface of the head and a turnback extending backwards from at least a part of the peripheral edge of the clubface;

a crown plate covering the top opening; and a sole plate covering the bottom opening, wherein the specific gravity Gm of the main frame, the specific gravity Gc of the crown plate, the specific gravity Gf of the face plate and the specific gravity Gs of the sole plate satisfy the following condition: Gm>Gf>Gs>Gc, the specific gravity Gf is not less than 3.0 and not more than 5.0, and the specific gravity Gm is not less than 4.0 and not more than 7.0, wherein said main frame includes an upper frame between the front opening and the top opening which forms a front part of the crown portion extending in a heel-and-toe direction of the head, and the minimum length of the upper frame in a back-front direction of the head is not less than 5 mm and not more than 30 mm.

2. The golf club head according to claim 1, wherein the main frame is made of a metal material.

3. The golf club head according to claim 1, wherein
the main frame, the face plate and the sole plate are each made of a metal material, and
the crown plate is made of a fiber reinforced resin.

4. The golf club head according to claim 1, wherein the main frame, the face plate, the sole plate and the crown plate are each made of a metal material.

5. The golf club head according to claim 1, wherein
the main frame is made of a titanium alloy
the face plate is made of a titanium alloy,
the crown plate is made of a magnesium alloy, and
the sole plate is made of an aluminum alloy.

6. The golf club head according to claim 1, wherein
the main frame is made of a titanium alloy,
the face plate is made of a titanium alloy,
the crown plate is made of a fiber reinforced resin, and
the sole plate is made of an aluminum alloy.

7. The golf club head according to claim 1, wherein
the main frame is made of a titanium alloy,
the face plate is made of a titanium alloy,
the crown plate is made of a magnesium alloy and
the sole plate is made of a titanium alloy.

8. The golf club head according to claim 1, wherein
the main frame is made of a titanium alloy,
the face plate is made of a titanium alloy,
the crown plate is made of a fiber reinforced resin, and
the sole plate is made of a fiber reinforced resin.

9. The golf club head according to claim 1, wherein said minimum length of the upper frame forming the front part of the crown portion is not less than 8 mm.

10. A golf club head having a hollow shell structure comprising:
a main frame provided with three independent openings which are a front opening, a top opening and a bottom opening;
a face plate covering the front opening, the face plate comprising a face portion forming the clubface of the head and a turnback extending backwards from at least a part of the peripheral edge of the clubface;
a crown plate covering the top opening; and
a sole plate covering the bottom opening, wherein
the specific gravity Gm of the main frame, the specific gravity Gc of the crown plate, the specific gravity Gf of the face plate and the specific gravity Gs of the sole plate satisfy the following condition: Gm>Gf>Gs>Gc,
the specific gravity Gf is not less than 3.0 and not more than 5.0, and
the specific gravity Gm is not less than 4.0 and not more than 7.0, wherein
said crown plate comprises: a generally-semicircular part forming an aft part of the crown portion; and a turndown extending downward from the arched rear edge of the aft part excepting the front edge, so that the crown plate covers said top opening which protrudes from the crown portion into the side portion, and the turndown forms an upper part of the side portion.

11. The golf club head according to claim 10, wherein the main frame is made of a metal material.

12. The golf club head according to claim 10, wherein
the main frame, the face plate and the sole plate are each made of a metal material, and
the crown plate is made of a fiber reinforced resin.

13. The golf club head according to claim 10, wherein the main frame, the face plate, the sole plate and the crown plate are each made of a metal material.

14. The golf club head according to claim 10, wherein
the main frame is made of a titanium alloy
the face plate is made of a titanium alloy,
the crown plate is made of a magnesium alloy, and
the sole plate is made of an aluminum alloy.

15. The golf club head according to claim 10, wherein
the main frame is made of a titanium alloy,
the face plate is made of a titanium alloy,
the crown plate is made of a fiber reinforced resin, and
the sole plate is made of an aluminum alloy.

16. The golf club head according to claim 10, wherein
the main frame is made of a titanium alloy,
the face plate is made of a titanium alloy,
the crown plate is made of a magnesium alloy and
the sole plate is made of a titanium alloy.

17. A golf club head having a hollow shell structure comprising:
a main frame provided with three independent openings which are a front opening, a top opening and a bottom opening;
a face plate covering the front opening, the face plate comprising a face portion forming the clubface of the head and a turnback extending backwards from at least a part of the peripheral edge of the clubface;
a crown plate covering the top opening; and
a sole plate covering the bottom opening, wherein
the specific gravity Gm of the main frame, the specific gravity Gc of the crown plate, the specific gravity Gf of the face plate and the specific gravity Gs of the sole plate satisfy the following condition: Gm>Gf>Gs>Gc,
the specific gravity Gf is not less than 3.0 and not more than 5.0, and
the specific gravity Gm is not less than 4.0 and not more than 7.0, wherein
said main frame includes an upper frame between the front opening and the top opening which forms a front part of the crown portion extending in a heel-and-toe direction of the head, and
the minimum length of the upper frame in a back-front direction of the head is not less than 5 mm and not more than 30 mm,
said crown plate comprises: a generally-semicircular part forming an aft part of the crown portion; and a turndown extending downward from the arched rear edge of the aft part excepting the front edge, so that the crown plate covers said top opening which opening protrudes from the crown portion into the side portion, and the turndown forms an upper part of the side portion.

18. The golf club head according to claim 17, wherein said minimum length of the upper frame forming the front part of the crown portion is not less than 8 mm.

19. The golf club head according to claims 1, 10 or 17, which further comprises
a weight member having a specific gravity larger than that of the main frame, wherein
the rear face of the main frame is provided with a hole into which the weight member is fitted, and
the hole is provided along the edge of the opening with a small protrusion protruding over the peripheral edge of the outer end of the weight member so as to secure the weight member in the hole.

* * * * *